US007472497B2

(12) United States Patent
Emerson et al.

(10) Patent No.: US 7,472,497 B2
(45) Date of Patent: Jan. 6, 2009

(54) SNOWSHOE BINDING WITH FLEXIBLE FOOTBED

(75) Inventors: Daniel T. Emerson, Berkeley, CA (US); Rudy Lucas Samuels, Los Angeles, CA (US)

(73) Assignee: K2 Snowshoes, Inc., Carlsbad, CA (US)

( * ) Notice: Subject to any disclaimer, the term of this patent is extended or adjusted under 35 U.S.C. 154(b) by 255 days.

(21) Appl. No.: 11/335,848

(22) Filed: Jan. 18, 2006

(65) Prior Publication Data

US 2007/0163154 A1 Jul. 19, 2007

(51) Int. Cl.
*A43B 5/04* (2006.01)

(52) U.S. Cl. ..... 36/122; 36/124

(58) Field of Classification Search ..... 36/122–125
See application file for complete search history.

(56) References Cited

U.S. PATENT DOCUMENTS 4,228,601 A 10/1980 Lawton et al.
5,440,827 A 8/1995 Klebahn et al.
5,687,491 A 11/1997 Klebahn
5,918,387 A 7/1999 Emerson
6,092,312 A * 7/2000 Neidhardt ..... 36/124
6,374,518 B2 4/2002 Warner
6,401,310 B1 6/2002 Warner et al.
6,526,629 B1 3/2003 Warner et al.
6,694,645 B2 2/2004 Messmer et al.
6,694,646 B2 2/2004 Messmer et al.
2002/0104235 A1 * 8/2002 Mahon et al. ..... 36/124

FOREIGN PATENT DOCUMENTS

WO WO9506502 3/1995

* cited by examiner

*Primary Examiner*—Ted Kavanaugh
(74) *Attorney, Agent, or Firm*—Thomas M. Freiburger

(57) ABSTRACT

A boot binding for a snowshoe, suspended within the snowshoe for flexibility of the boot relative to the snowshoe in the pitch direction, has a binding footbed that is flexible and allows bending of the boot in the pitch direction, as steps are taken by the user.

9 Claims, 4 Drawing Sheets

SNOWSHOE BINDING WITH FLEXIBLE FOOTBED

BACKGROUND OF THE INVENTION

This invention concerns snowshoes of the type having a boot binding secured to the snowshoe, either permanently or removably. Specifically the invention encompasses a snowshoe binding with a footbed having flexibility to allow the user's boot to flex in the natural way as steps are taken in use of the snowshoe.

Snowshoe bindings, and bindings for cleats or other terrain-engaging footgear, are shown in Atlas Snowshoe Co. U.S. Pat. Nos. 5,440,827, 5,918,387, 6,374,518, 6,401,310, 6,526,629, 6,694,645 and 6,694,646. U.S. Pat. No. 5,687,491 disclosed a contoured footbed in a boot binding (the term "boot" as used herein refers to a boot or a shoe). U.S. Pat. No. 6,694,646 disclosed a snowshoe harness with buckles and straps configured such that a single pull can tighten the harness down over the boot, and including toe area and arch area straps whose tails were connected together as a loop, such that the user need only pull on the loop. As shown in nearly all the above listed patents, a heel strap is provided to secure the user's boot in the binding, to prevent against pulling back of the boot from the tightened toe and arch areas on the binding during use of the snowshoe or cleat device.

Generally a user's boot is bound in a principally immobilizing manner to a snowshoe binding, by straps at the toe area, over the arch area and around the rear of the boot, on a footbed that is basically inflexible. This binding system has worked well, but it would be desirable to afford the user greater comfort and ease of use by allowing the boot to flex in the natural manner, at the metatarsal phalangeal joint of the foot, as occurs when normal steps are taken.

SUMMARY OF THE INVENTION

Pursuant to the invention now described, a flexible footbed is provided in a snowshoe boot binding, with flexibility for bending at the metatarsal phalangeal joint of the foot, unhindered by any harness elements above the footbed that would tend to inhibit flexing. The footbed is only rigid at the toe area, forward of the metatarsal phalangeal joint location (where it is secured to a toe cleat), and the over-the-boot strap in the arch region is secured to the back of a flexibly compliant footbed element.

In one implementation of the invention, a boot binding for a snowshoe has a footbed on top of a metal toe cleat, the footbed being secured at a toe end of the footbed to the metal cleat and having at least a section of the footbed or a portion of a connector between the toe end and an arch bearing pad, which is flexible aft of the toe region, in a position to receive a user's metatarsal phalangeal joint when a boot is secured in the binding. A toe strap and an arch region strap are included in the binding, both being secured to the footbed, and each being independently secured and unhindered by webbing between the straps such that the footbed is free to bend in the pitch direction as steps are taken by a user and the boot is flexed, without inhibition from the straps and harness.

In one specific embodiment of the invention the width of the snowshoe binding and strap engagement against the boot in the arch area are adjustable, preferably via a simple slide mechanism, to accommodate boots of different widths. The arch region strap and an adjustment buckle for the strap are so arranged that the pulling of the arch region strap to tighten the binding will tend to pull the slide adjustment device into contact with the sides of the boot as the strap is tightened.

Also, in a preferred embodiment the binding includes a loop type strap pull arrangement, such as disclosed in U.S. Pat. No. 6,694,646 referenced above, which is incorporated herein by reference. Thus, a single pull on a loop formed of the two strap ends will tighten the binding harness down against the boot at both toe and arch areas simultaneously.

At the arch region the footbed is relatively stiff, forming a rigid or semirigid platform for engagement by the boot sole at the arch or just forward of the arch, for a firm engagement with the boot, rather than the single point strap connection near the arch area as shown in U.S. Pat. No. 6,694,646. The result is that the boot is more firmly retained against the footbed and, with the slide adjustment noted above, gripped laterally from the sides of the boot when the straps are tight, so that the boot is far more stable against looseness and rotation in the horizontal or ground plane (yaw axis) during use of the snowshoe.

In a preferred embodiment a heel strap of advantageous construction is secured to the webbing apparatus.

It is thus among the objects of the invention to improve on boot bindings for snowshoes or other terrain-engaging footgear such as snow cleats or ice cleats, by providing for flexing of the binding and therefore the boot in the pitch direction, at the metatarsal phalangeal joint of the foot, in an efficient and rugged construction. These and other objects, advantages and features of the invention will be apparent from the following description of preferred embodiments, considered along with the accompanying drawings.

DESCRIPTION OF PREFERRED EMBODIMENTS

Figure 1:
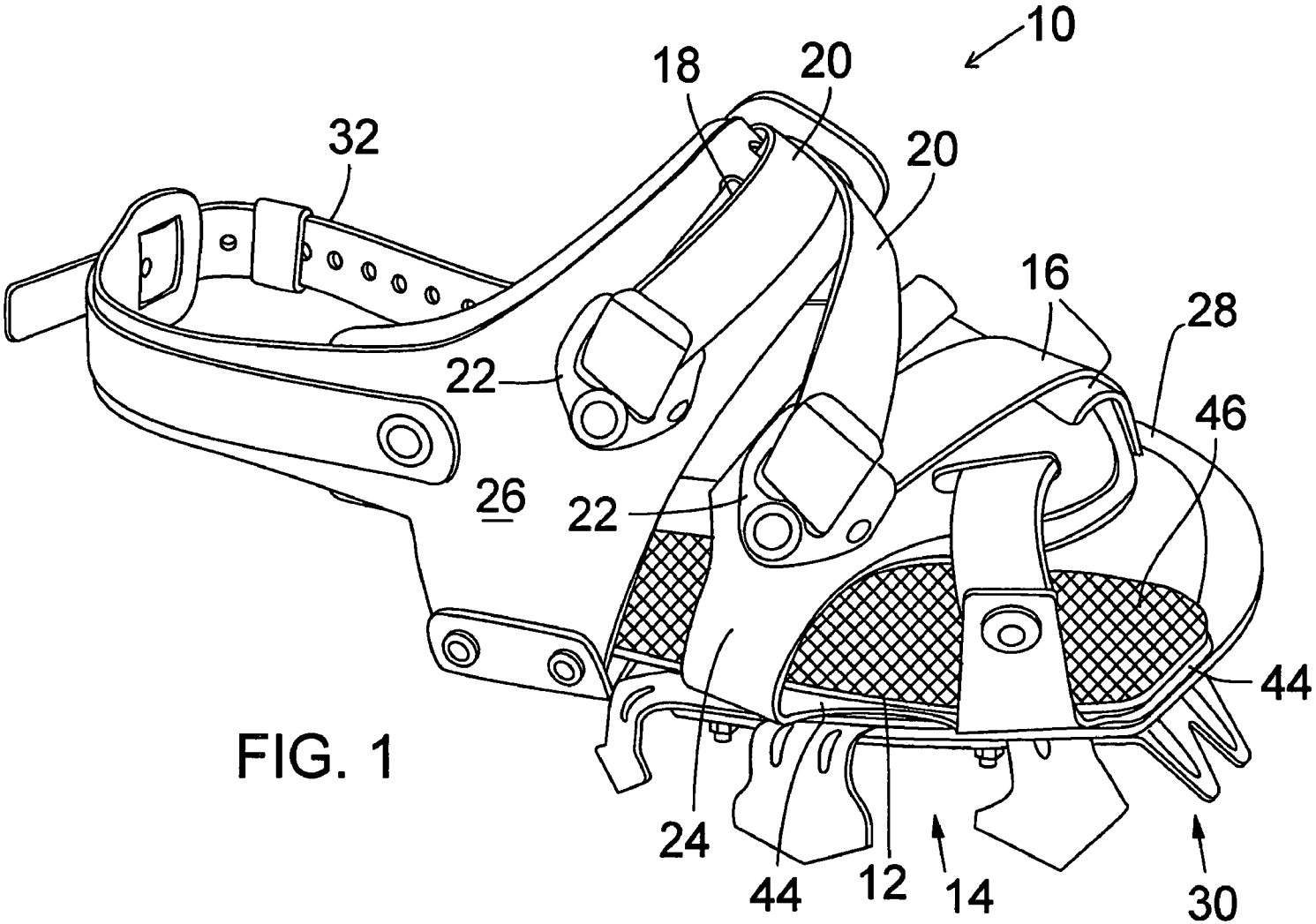
FIG. 1 is a perspective view showing a snowshoe binding of the invention, shown detached from a snowshoe.

In the drawings, FIG. 1 shows a binding 10 for retaining a user's shoe or boot ("boot" herein), either in a snowshoe to which the binding is attached, or simply as a cleat for walking on icy terrain or densely packed snow. As explained above, the binding 10 allows bending of the boot and shoe in the natural manner when a user takes steps. This is accomplished via a footbed 12 which is flexible, allowing bending in the pitch direction, particularly at the location where the user's metatarsal phalangeal foot joint will be located. The footbed is mounted onto a metal cleat 14 just below the footbed, cleats of this type being shown in many of the above listed patents, the cleat typically being of stainless steel although sometimes of aluminum. The drawings show that the binding can be constructed generally in accordance with what is shown in U.S. Pat. No. 6,694,646, with a doubled-over and return type strap 16 over the toe region of the boot and another strap 18 generally over the arch region, and a loop pull 20 formed from the connected ends of the two straps 16 and 18, these straps preferably being continuous as one single strap. As described in the '646 patent, slip-through locking buckles 22 are secured to webbing or harness shell sections 24 and 26 at one side of the binding. A pull on the loop handle 20 will tighten both the toe strap and the arch strap simultaneously. At a side of the binding opposite that shown in FIG. 1, a harness element 28 is generally arch-shaped, extending from the toe end 30 of the footbed back along the one side of the binding to the arch area. This is better seen in FIG. 2. The toe strap 16 slips through this harness element 28 and thus is afforded adjustability in position by slipping fore/aft along the element 28, as explained in the '646 patent, and as can be envisioned from FIGS. 1 and 2.

In the binding 10, the harness elements, such as the elements 24 and 26 shown in FIG. 1, are separated, preferably down to the footbed 12, so that flexing can occur during walking. This is true on both sides of the binding.

The binding 10 in the embodiment illustrated includes a heel strap 32, secured to harness components 26 and 34 (34 is visible in FIG. 2), and this can be formed similarly to the heel strap shown in the '646 patent and in other patents referenced above.

Figure 2:
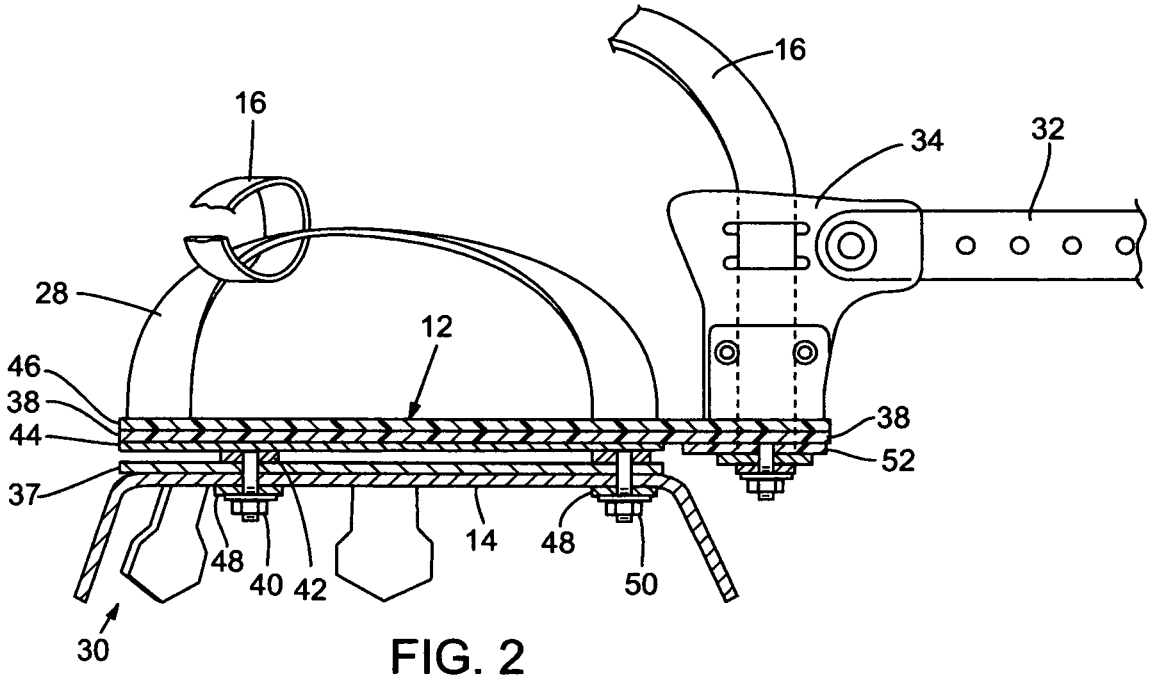
FIG. 2 is a side elevation cross section view showing construction of a footbed portion of the binding.

FIG. 2 shows the flexible footbed 12, attached cleat 14, and other elements in greater detail, in a transverse cross sectional elevation view. The cleat 14 is substantially rigid, formed of metal. To the top of the cleat 14 in this preferred embodiment is secured a base 37 to which is integrally connected to the harness element 28 that arches upwardly at one side of the binding. The arch element 28 could be secured to the cleat otherwise, without requiring the base sheet 37 if desired. Also, the base sheet 37 could be eliminated if desired.

The remainder of the structure shown in FIG. 2, above the cleat, provides for bending with the natural bending of a boot secured in the binding. The footbed 12 has a main footbed component 38 that is a flexible, preferably plastic sheet, strong enough for the stresses of repeated flexing and of pulling against its securement to the cleat during use of the snowshoe, as well as having properties to withstand these stresses in a cold environment. Some polyurethanes have acceptable properties. The flexible element 38 is secured down to the cleat 14 near the front end 30 of the binding, as by rivets or by bolts 40 as indicated in the drawing. It may be spaced above the cleat (or above the base element 37, if included, which is on top of the cleat) by a short distance if desired, thus the spacer 42 shown in the drawing. The location of this connection is generally at the location of the toes in the user's boot, forward of the location of the metatarsal phalangeal joint of the foot, so that the flexible footbed element 38 is permitted to bend appropriately with the sole of the boot as the user takes steps in the snowshoe or snow cleat footgear.

As is seen in FIG. 2, the fasteners 40 (of which there may be several across the width of the binding) retains other elements to the cleat as well. Just below the flexible footbed element 38 is shown a base sheet 44 of a harness element at the opposite side from the element 28, that is, at the near side of the binding that is not seen in FIG. 2. The base sheet 44 is integrally connected to the harness members 24 and 26 seen in FIG. 1, and the base sheet 44 itself is visible to some extent in FIG. 1. Thus, in this particular embodiment the harness member 24 near the arch area at one side of the binding is allowed to float upwardly along with the footbed upon bending of the boot as steps are taken with the binding, while the harness element 28 at the opposite side of the binding is fixed to the cleat at both forward and rear ends. The looping arch shape of the element 28, however, allows flexibility via the connection of the forward strap 16, so that the element 28 can deform in shape and the strap 16 can slide forward or back as needed, as steps are taken. All this contributes to comfort for the user.

The forward fasteners 40 are covered at the top side by a rubbery or elastomeric sheet 46, preferably with a high-friction surface, against which the boot sole presses. This can be secured down to the flexible footbed element 38 by adhesive. At the bottom of the fasteners 40, FIG. 2 shows that a forward tensioned suspension strap 48, for suspension of the binding on a snowshoe, can be retained to the bottom of the cleat. Similarly, a plurality of fasteners 50 toward the aft end of the cleat can retain a rear tensioned suspension strap 48. These suspension straps retain the binding in place on a snowshoe, as in many of the Atlas Snowshoe Company patents referenced above, such that the binding is biased in a toe-downward position in the snowshoe. If the binding 10 is not permanently secured to a snowshoe, these suspension straps 48 would not be in the positions shown.

Figure 3:
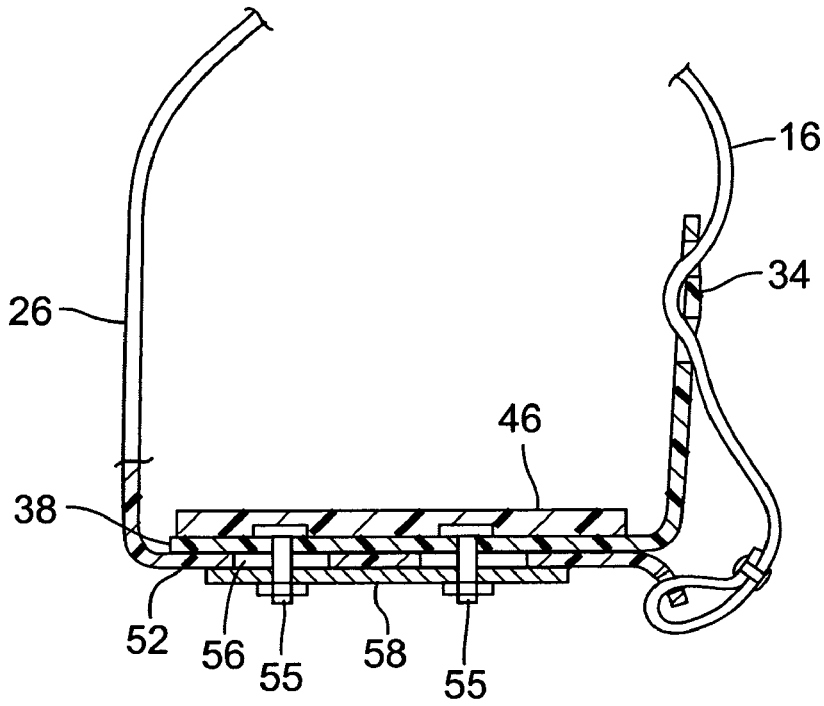
FIG. 3 is a detail view in cross section showing a laterally slidable adjustment at or near the arch area of the binding.

At the rear of the flexible footbed element 38 a width adjustment slider 52 may be included, to accommodate different widths of user's boots generally at the arch region. This slider is also seen in the transverse cross sectional view of FIG. 3. In that view the sliding element 52 is seen retained by a pair of fasteners 55, which extend through a slot 56 of the slider 52 and are engaged through the main flexible footbed element 38 at the top and to a retaining strip 58 at the bottom. This allows the sliding piece 56 to slide laterally for width adjustment without much friction. The user's boot is inserted into the binding with the sliding element pulled out to maximum width. When the straps are tightened using the loop pull 20 (FIG. 1), this pulls the sliding element inward so that the harness member 26 engages snugly against the side of the boot.

Figure 4:
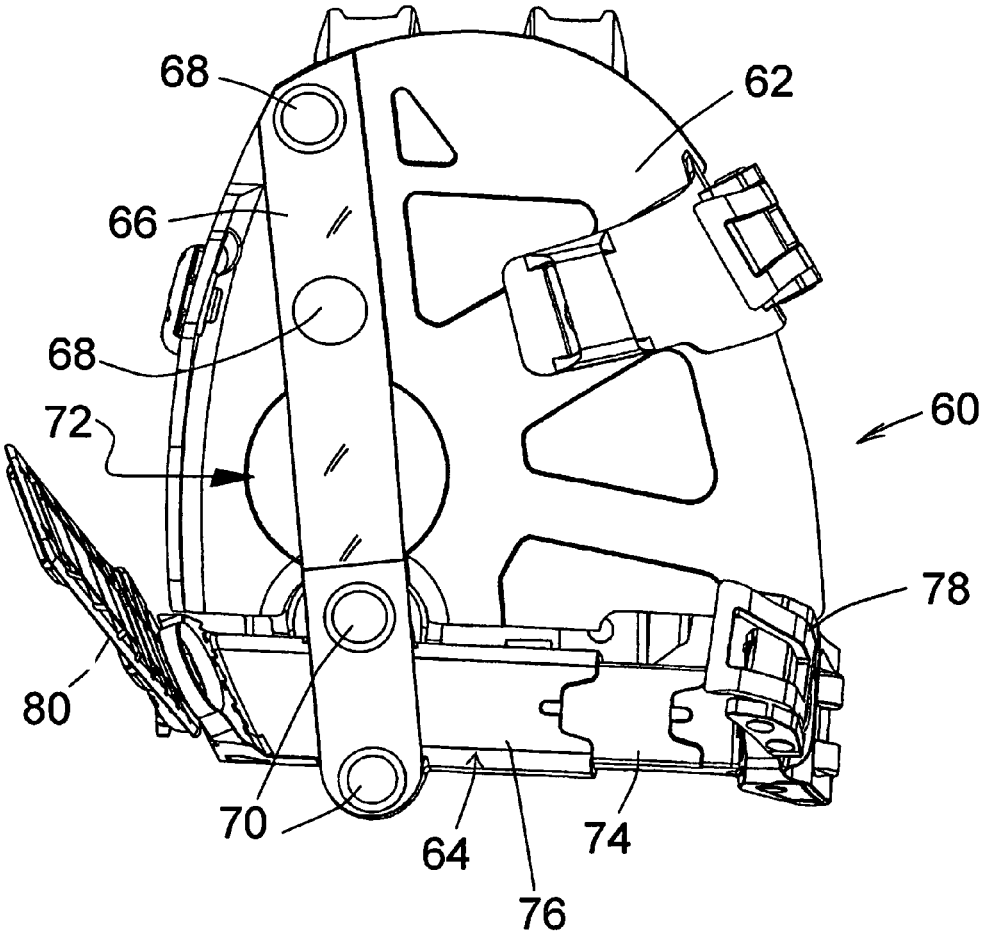
FIG. 4 is a plan view showing another form of flexible connection between front and rear of the footbed.

FIG. 4 shows another form of the flexible footbed 60 of the invention, performing the same function as described above. A forward portion 62 of the footbed can comprise the major portion of the footbed, as shown in FIG. 4. An aft portion 64 can comprise basically an arch supporting bar generally at the arch area, with forward and aft portions 62 and 64 secured together by a leaf spring 66, which can be, for example, a stainless steel strip. This strip of the spring metal can be firmly secured to the forward footbed portion 62 by rivets 68. Both rivets 68 are toward the front of the forward portion 62, so that, behind about 40 percent of the length of the footbed, the strip or spring 66 is not bonded to the front part 62 of the footbed.

The aft portion 64 or arch support bar is shown secured to the metal strip or leaf spring 66 by two rivets or the fasteners 70. The strip 66 is selected to be wide and strong enough to firmly retain the two portions 62 and 64 of the footbed in the relative positions generally as shown, while providing enough springable flexibility to allow bending of the foot at the metatarsal phalangeal joint location. This location is aft of the back rivet 68, generally at a region identified approximately at 72 in the drawing. This construction.

FIG. 4 also shows that the width adjustment can be afforded by a slide bar 74 in the aft or arch support portion 64, slidable in/out within a slider body 76. A buckle is shown on the slider at 78, and a strap on the opposite at 80, although other strap arrangements can be used such as described above.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. In a snowshoe having a boot binding, the improvement comprising the boot binding having a flexible footbed with flexibility for bending at the metatarsal phalangeal joint of a user's foot, the footbed being, generally at the metatarsal phalangeal joint location, flexibly compliant and bendable in the pitch direction to allow the user's boot and metatarsal phalangeal joint of the foot to bend as steps are taken in the snowshoe, and including, at an aft end of the footbed generally in an arch region of the boot, a means for holding the boot down to the footbed.

2. The snowshoe with boot binding of claim 1, including a metal toe cleat below the footbed, the footbed being secured at a toe end of the footbed to the metal cleat, with the footbed being flexibly compliant aft of the toe region, in a position to be under a user's metatarsal phalangeal joint when a boot is secured in the binding.

3. The snowshoe with boot binding of claim 1, wherein the means for holding comprises an over-the-boot strap secured to the footbed.

4. The snowshoe with boot binding of claim 3, including a toe strap, both straps being secured to the footbed and each being independently secured and unhindered by harness webbing between the straps such that the footbed is free to bend in the pitch direction as steps are taken by a user and the boot is flexed.

5. The snowshoe with boot binding of claim 1, wherein the width of the snowshoe binding is adjustable, via a slide mechanism, to accommodate boots of different widths.

6. The snowshoe with boot binding of claim 5, wherein the means for holding comprises an over-the-boot strap secured to the footbed.

7. The snowshoe with boot binding of claim 5, including an adjustment buckle on the arch region strap, and wherein the arch region strap and the adjustment buckle are so arranged that the pulling of the arch region strap to tighten the binding tends to pull the slide mechanism into contact with the side of the boot as the strap is tightened.

8. The snowshoe with boot binding of claim 7, wherein the binding includes a loop with the two free ends of the straps connected together, such that a single pull on a loop formed of the two strap ends will tighten the binding harness down against the boot at both toe and arch areas simultaneously as well as pulling the slide mechanism inwardly to engage the boot.

9. The snowshoe boot binding of claim 1, wherein the footbed includes separate forward and aft portions connected by a flexible leaf spring.

* * * * *